United States Patent [19]

Fioretto

[11] 4,022,859

[45] May 10, 1977

[54] METHOD OF PRODUCING SHAPED CONCRETE BLOCKS FOR HYDRAULICS

[75] Inventor: Mauro Fioretto, Trana (Turin), Italy

[73] Assignee: Montan - Castell A.G., Burgdorf, Switzerland

[22] Filed: Dec. 12, 1974

[21] Appl. No.: 532,003

[30] Foreign Application Priority Data

Dec. 14, 1973 Switzerland ..... 17515/73

[52] U.S. Cl. ..... 264/69; 61/4; 249/171; 249/172; 264/71; 264/336

[51] Int. Cl.² ..... B28B 1/08

[58] Field of Search ..... 264/71, 72, 69, 336, 264/23; 249/50, 170, 171, 172; 61/4

[56] References Cited

UNITED STATES PATENTS

| | | | |
|---|---|---|---|
| 2,161,822 | 6/1939 | Kogl | 249/170 X |
| 2,264,948 | 12/1941 | McKenzie | 264/69 |
| 2,900,699 | 8/1959 | Danel | 249/166 |
| 3,009,229 | 11/1961 | Tumey | 249/50 |
| 3,582,034 | 6/1971 | Tsuzuki | 61/4 X |
| 3,636,713 | 1/1972 | O'Neill | 61/4 |
| 3,830,458 | 8/1974 | Hamblin | 249/50 |

*Primary Examiner*—Thomas P. Pavelko
*Attorney, Agent, or Firm*—Imirie, Smiley & Linn

[57] ABSTRACT

A method of producing shaped concrete blocks for hydraulics, such blocks having two spaced arms formed at right angles to each other and spaced from each other and a web interconnecting the centers of said arms, wherein said block is formed by concreting in a dismountable shuttering with the arms located horizontally and the web vertically, it being possible to use a shuttering having a stationary, lower shuttering part which has a horizontal longitudinal axis for forming substantially half of one arm of the block and two shuttering parts separatable from the formed block by lateral movement.

6 Claims, 6 Drawing Figures

METHOD OF PRODUCING SHAPED CONCRETE BLOCKS FOR HYDRAULICS

BACKGROUND OF THE INVENTION

The present invention relates to an improved method of producing a shaped concrete block or brick for hydraulics, more particularly for harbor installations, having two arms spaced apart at right angles to each other and a web connecting the centers of the arms, and an installation for enabling the method to be carried out.

Shaped concrete bricks of this kind are already known for harbor installations and more particularly for external harbor workings, dams and the like hydraulics. The arms of the bricks normally have two symmetrically outwardly tapering pyramid-shaped parts or truncuted cone-shaped parts, and the web is prismatic or cylindrical. These shaped concrete bricks have hitherto been concreted with their web and one arm in a horizontal position and with the other arm in a vertical position. Type of shuttering for concreting shaped bricks in the manner stated above and the shaped brick is shown diagrammatically in FIG. 1.

SUMMARY OF THE INVENTION

It is an object of the invention to rationalise and improve the production of shaped concrete blocks or bricks of the above type.

According to the present invention a method of producing a shaped concrete block or brick for hydraulics, having two spaced arms formed at right angles to each other and a web connnecting the centers of the arms as characterised by the feature that the shaped concrete brick is formed by concreting in a dismountable shuttering with the arms located horizontally and the web vertically.

As is shown in detail by way of an embodiment, this method permits the disadvantages of the known method to be avoided or to be minimized. The invention enables a large proportion of the shuttering to be removed such that the shaped brick may be lifted-out of the fixed shuttering part by means of straps placed around it. This shuttering part remaining in position until the shaped brick is removed, comprises only about 25% of the shuttering area, so that the greater proportion of the shuttering can soon be removed and used again. The invention also makes it sufficient to provide a filling opening at one point and a uniform, intensive vibration is also possible.

Also according to the invention an apparatus or installation for carrying out the method of producing a shaped concrete brick having two spaced apart arms arranged at right angles to each other and an interconnecting web wherein the brick is formed by concreting in a dismountable shuttering with the arms located horizontally and the web vertically comprises a shuttering having a stationary, lower shuttering part which has a horizontal longitudinal axis for forming substantially half of one arm of the shaped concrete brick and two shuttering parts separable by lateral movement.

The upper shuttering parts are preferably each formed by two halves which may be swung away sideways about swivel bearings. The halves of one shuttering part hence are located in the plane of the web and the upper arm of the shaped concrete brick to be produced and define these parts laterally or below, whilst the other shuttering part defines the space of the web and the upper arm of the shaped concrete brick laterally and above and the space of the lower arm at the top. Since one displaceable shuttering part supports the upper arm of the concrete shaped brick, the other shuttering part may soon be removed from the concreted shaped brick and re-used. This shuttering part soon to be removed may form a considerable proportion of the whole shuttering area up to 75%. The shuttering parts are readily and favorably separated from one another for transportation.

The invention will be described further, by way of example, with reference to the accompanying drawings.

BRIEF DESCRIPTION OF THE DRAWINGS

As shown in FIG. 1, the shaped brick still rests wholly in the lower shaped part 4 even after removal of the upper shaped part (not shown) and the lateral shaped part 5. It is accordingly not possible to place belts or ropes around the shaped part to lift it out of the lower fixed shuttering part 4. It is therefore necessary to concrete lifting anchors 7 in the shaped brick, by means of which it may be lifted after the concrete has set sufficiently. For concreting the shaped brick in the position and in shuttering of FIG. 1, it is necessary to provide filling openings on the upper shuttering part (not shown) generally at three points, namely at least in the region of the vertical arm 2, the horizontal arm 3 and the web 1, such that at least the openings in the region of web 1 and the arm 3 have to be closable. Apart from this aggravation of the concreting operation, which has to be interrupted to close the openings, it is also difficult for the concrete to be sufficiently and uniformly vibrated in the whole shaped brick. Finally, whilst the upper shuttering part (not shown) is removable after a relatively short setting time of the shaped concrete brick and can hence be re-used relatively soon, this removable upper part occupies only about 45% of the overall shuttering area. The larger proportion of the shuttering can hence only be re-used when the shaped brick has set to such an extent that it can be lifted out of the lower shuttering part by the anchors 7.

Figure 1:
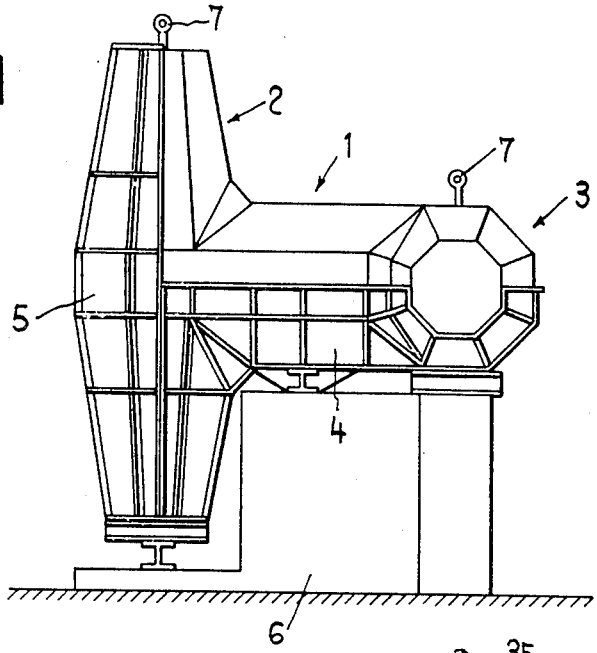
FIG. 1 is an elevational view of a type of shuttering for producing shaped concrete bricks for hydraulics.

The shuttering shown in FIG. 2 – 6 has a fixed shuttering part 10 resting on simple bases. Theshuttering area of part 10 serves to define the three lower lateral surfaces of the octagonal substantially double pyramid-shaped space to form a lower, horizontal arm, e.g. to form the arm 3 of the shaped concrete block or brick. This shuttering part 10 only forms an elongate channel which is open at the end face. Two mirror-image halves of a lateral shuttering part 12 are each pivotally connected to the lower shuttering part 10 by means of a pivot bearing 11. The shuttering area 13 of each half of the shuttering part 12 forms a side of an octagonal space for forming the web 1 of the shaped concrete brick, and also each forms the lower side of half the space for forming the upper arm 2 of the shaped concrete brick. The halves of the shuttering part 12 each have a support framework 14 by means of which they are supported on hydraulic presses 15. Intermediate elastic or resilient layers 16 and 17 of damping material e.g. Neoprene are interposed in gaps in each half of the two shuttering parts and their respective support frameworks 14 so that vibrations from the lower section are not transmitted or only transmitted to an insignificant extent to the upper. The halves of the shuttering 12 each form the end face shuttering surfaces 18 for forming the upper arm 2 of the shaped concrete brick.

Finally, the shuttering has an upper shuttering part which like the lateral shuttering part 19 comprises two halves arranged in mirror image fashion, which halves are pivotally interconnected at the top by pivot bearings 20. This shuttering part forms shuttering surfaces 21 at the end faces of the space for forming the lower arm 3, shuttering surfaces 23 which correspond to two lateral and three upper sides of the space for forming the lower arm 3, shuttering surfaces 24 to form three sides each of the web 1 and shuttering surfaces 24 to form the seven upper sides of the upper arm 2 of the shaped brick. The halves of the shuttering part 19 are each provided with a support framework 25, which is provided with eyelets 26 for lifting the shuttering part (see FIG. 4). Also, the halves of the shuttering part 19 or their support frameworks are provided with elastic or resilient interpostions 27 or 28 in gaps thereof for stopping or minimizing the transmission of vibrations. These gaps with intermediate layers 16, 17 or 27, 28 which divide the whole shuttering into an upper and a lower section, also permit certain vertical reduction of the shuttering when the concrete shrinks during setting. The shuttering parts may also be separated at the gaps for transportation.

The axle 20' of each pivot bearing 20 is extended outwards (FIG. 6) and supported on a support 29. The support has a spindle 30 and may be vertically adjusted by means of a nut 31. The two supports are mounted on the halves of the shuttering part 12. The nut 31 is mounted by means of an axial ball bearing and therefore easily rotatable even when subjected to high stress.

Eyelets 32 are provided at the lower end of each half of the upper shuttering part 19, and may be coupled to hydraulic presses 33 anchored on the lower shuttering part 10.

The halves of the shuttering part 19 are provided at the top with a platform 34 and with railings 35 for the operators, whereby with the support framework of at least one half of the shuttering part 12, a ladder may be connected which leads to the platform 34. When the shuttering is closed in accordance with FIG. 2, the railing members have inclined inside struts 36 which act as stops in a manner described hereinafter. The platform 34 may have a railing on all sides which is (not shown) in the drawing for the sake of simplicity.

Vibrators 37, are mounted on the section of the shutter part 10 located on the lower shuttering part 10 and beneath the joint or intermediate layer 27 and serve for the vibration of the concrete in this lower shuttering section.

The halves of the shuttering part 19 form an elongate concreting opening 38 (FIG. 3) in the platform 34.

Figure 2:
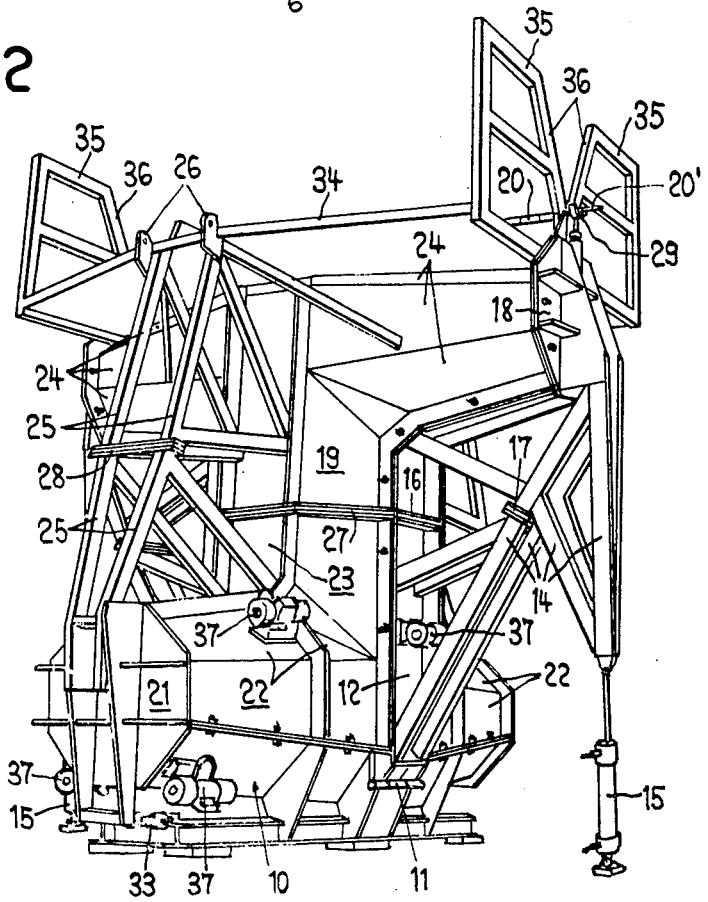
FIG. 2 is a perspective view of a shuttering installation in accordance with the invention.
Figure 3:
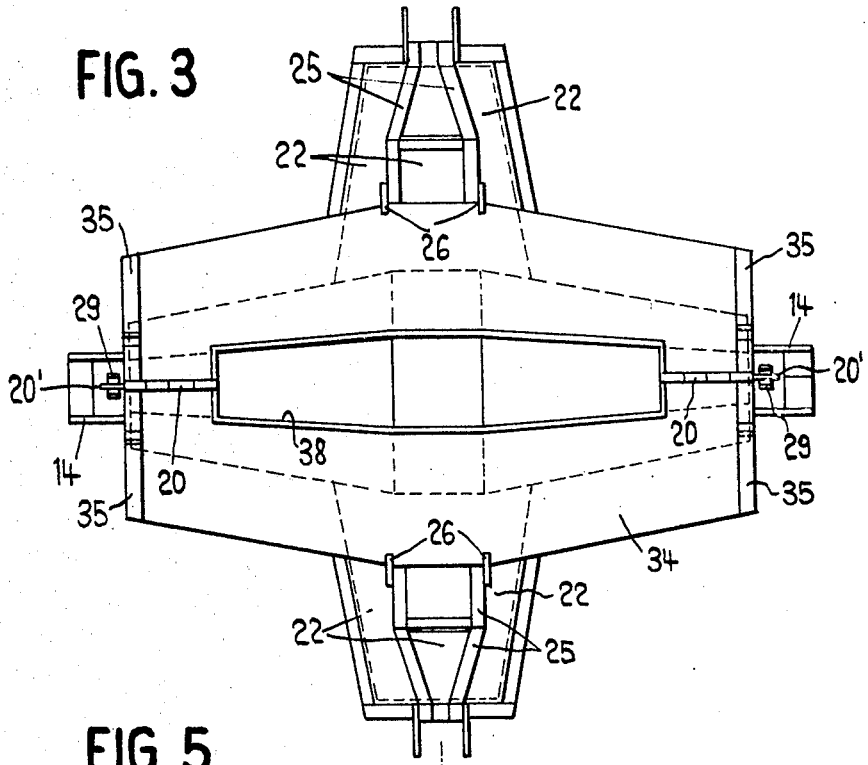
FIG. 3 is a plan view of the shuttering of FIG. 2.

All shuttering parts have flanges by means of which they may be joinedly screwed together, as indicated in FIG. 2.

Since a large number of shaped concrete bricks are usually required, they are produced by means of a plurality of shutterings which are preferably located in a row below a travelling crane. The travelling crane, in a manner as described below, is thus used to transport shuttering parts, to supply concrete and for transporting the completed shaped concrete bricks.

FIG. 2 shows the shuttering in a completely assembled state ready for concreting a shaped brick. All shuttering parts are securely screwed together by means of their flanges. The hydraulic presses 15 are subjected to a certain pressure to absorb a proportion of the pressure acting on the halves of the shuttering part 12. Concrete is charged from above throgh the opening 38 whereby at first the lower arm 3 is concreted. The vibrators 37 are hence actuated and vibrate the concrete intensely and uniformly. The vibration thus remains largely restricted to the lower section of the shuttering. The web 1 and finally the upper arm 2 are then concreted so that the concrete charged via the joint 16, 27 is vibrated by means of vibrator rods suspended therein from above. Finally, the upper surface of the shaped brick in the region of the opening 38 is shaped by hand or, alternatively, a cover substantialy sealing-off this opening is inserted and the rest of the concrete then charged and vibrated to form the upper surface of the arm 2. During the setting of the concrete which now commences, there is a slight shrinkage thereof. To permit the shuttering to follow this shrinkage and to prevent excessive stresses to occur, which could possibly lead to fissurisation, the joints are provided with the intermediate layers 16, 17 and 27, 28.

Figures 4, 6:
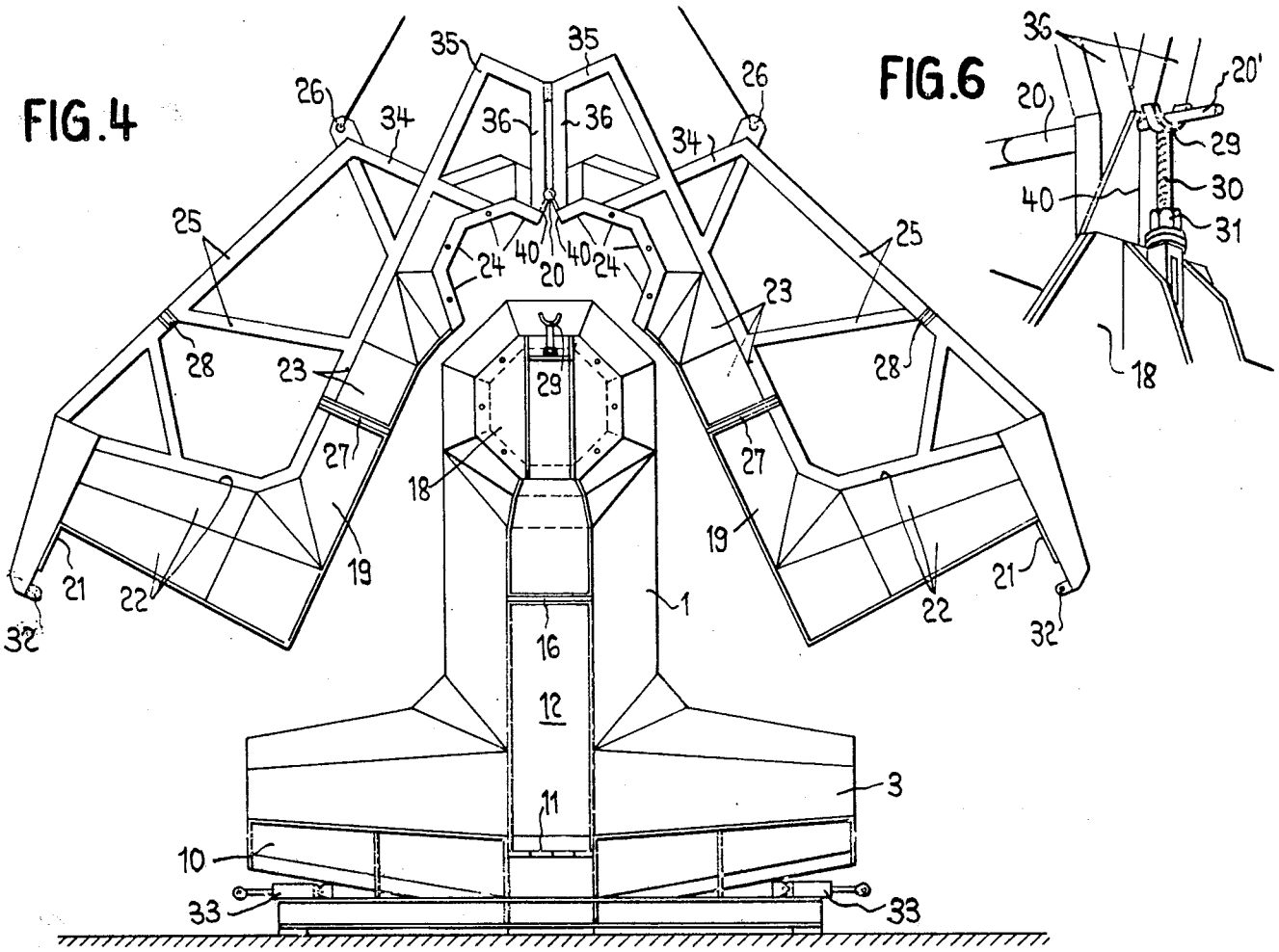
FIG. 4 is a side view of the shuttering of FIG. 2 during the removal of the removable shuttering part.
FIG. 6 is an enlarged fragmentary perspective view of a structural detail of the apparatus of FIG. 2. Description of the Preferred Embodiment A type of shuttering for concreting shaped blocks or bricks is shown in FIG. 1 and has a horizontal central portion (only partially shown) for shaping the web 1, a vertical, double truncuted cone-shaped portion for shaping the vertically upright arm 2 and a horizontal, double truncuted cone-shaped portion for forming the other horizontal arm 3 of the shaped concrete brick. The shuttering is hence built-up from a lower, fixed shuttering part 4 which forms the lower half of the arm 3, the lower half of the web 1 and one side and the end face of the lower part of the arm 2; is built-up from an upper removable part (not shown) which forms the upper surface of the arm 3 and the web 1 and the right-hand half of the upper part of arm 2; and also built up from a lateral, removable part 5. A costly base 6 is required for the fixed lower part 4 of the shuttering.

In a relatively short period, the concrete sets to such an extent that the upper shuttering 19 may be removed. For this purpose, the connecting screws between this shuttering part and the shuttering parts 10 and 12 are released. Moreover, a test is effected to ascertain as to whether the axle ends 20' of the pivot bearing 20 of the shuttering part 19 abut flush against these supports 29 and, if necessary, these supports are screwed flush against the axle ends 20'. The travelling crane is then moved to a position over the shuttering, tension cables 39 latched in the eyelets 26 of the shuttering part 19 (FIG. 4), and a proportion of the weight of the shuttering part is absorbed by the crane. The hydraulic presses 33 are then actuated to separate the two halves of the shuttering part 19 sideways from the concreted shaped brick. The halves of the shuttering parts are then lifted further by the traveling crane; these halves, as shown in FIG. 4, first being swung outwards because the active lines of the pull of the cables engaging on the eyelets 26 pass through outside the centers of gravity of the halves of the shuttering part 19. The shuttering parts are pivoted about the axles 20' which still abut on the supports 29 with a certain pressure. During the swinging out, the edges 40 of the halves of the shuttering parts are unable to abut with substantial pressure against the upper surface of the shaped brick or even penetrate and damage it, but they move horizontally outwards and become immediately detached from the shaped brick. When both railing struts 36 (as shown in FIG. 4), have reached a stop, the pivotal movement for opening both halves of the shuttering part 19 has terminated, and the shuttering parts are now lifted by the travelling crane and then caused to assume a position over another shuttering part 10. Here the shuttering part is lowered, so that the axle ends 20' engage in the supports 29 whereupon the halves of the shuttering part are closed-up until they can be coupled to the hydraulic presses 33. If necessary, the remaining shuttering parts are then bolted. The shuttering part may hence be immediately used again together with two free shuttering parts 10 and 12.

Figure 5:
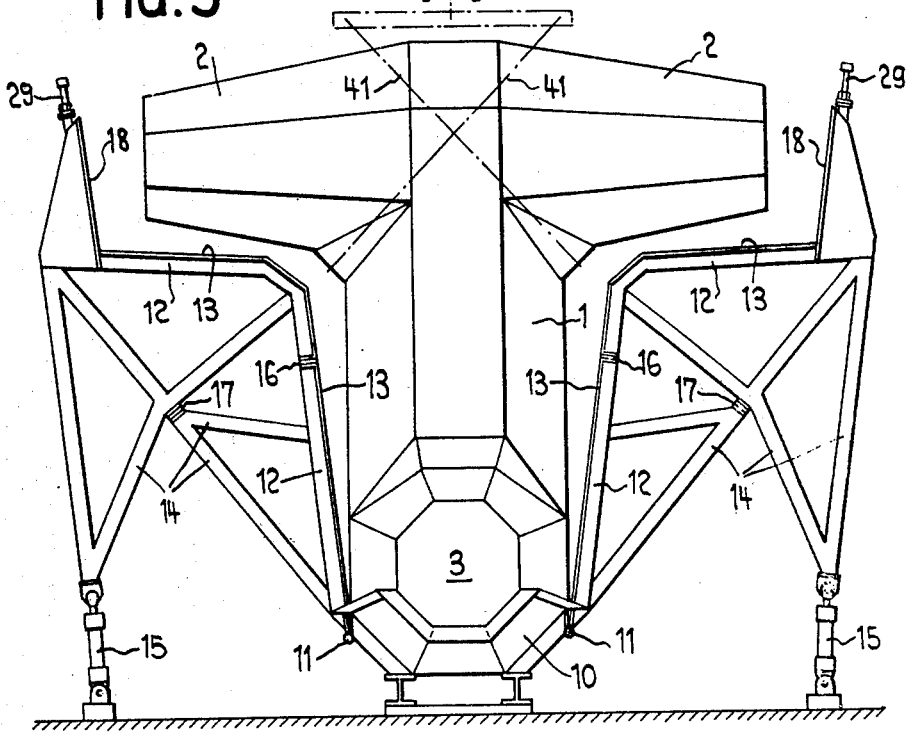
FIG. 5 is an end elevational view of the apparatus of FIG. 2 showing the displaceable lower part spread apart.

During this period the shuttering parts 10 and 12 in accordance with the aforesaid concreted shaped brick, remain in the position they have assumed during concreting so that the presses 15 now have to support the whole weight. After a further lapse of time during which the shaped concrete brick has set sufficiently for its first careful transportation, the two halves of the shuttering part 12 (as shown in FIG. 5) are then pivoted outwards away from the shaped brick since the pressure is drained from the presses 15 or the direction of pressure therein is reversed. The shaped concrete brick is now located only in the fixed, lower shuttering part 10. In a manner as indicated by chain-dotted lines in FIG. 5, belts 41 are laid crosswise around the upper arm 2 of the shaped brick and the latter then lifted by means of the travelling crane. Hence the shuttering becomes free from producing a new, shaped brick. After cleaning and greasing, the part 10 may be joined to a shuttering part 19 which as become available elsewhere and immediately used for concreting a further shaped brick.

It is evident from the above that the two shuttering parts 10 and 12 remain constantly in situ and about 25% of the shuttering area whilst the greater proportion of about 75% of the shuttering surface is formed by the upper, removable shuttering part 19. This substantially larger shuttering part 19 may be re-used in substantially fast sequence. Generally, one shuttering part 19 will be provided on each two shuttering parts 10 and 12. As mentioned above, a number of stationary shuttering parts 10 and 12 are usually located beneath a travelling crane. It is, however, not impossible, when, for example, prefabricating directly on a building site, to operate with a different lifting tackle, e.g. a mobile crane.

It is also possible to provide shell vibrators 37 over the joint or over the intermediate layer 16 or 27 on the upper shuttering part 19 or on the lateral shuttering part 12. Since, however, these vibrators, for economic reasons, are not permanently retained on the shuttering but are mounted only just during the concreting on a shuttering, it is preferable to provide vibrators only below where they can be easily mounted and removed.

The shaped concrete bricks to be produced may be reinforced, in that a prepared reinforcement having suitable supports is placed on the lower shuttering part 10 before the upper shuttering part 19 is placed in position and the shuttering parts bolted together. The reinforcement may also have lateral supporting elements which prevent it from tilting sideways during concreting.

What we claim is:

1. A method of producing a shaped concrete block having two spaced arms formed at right angles to each other and a web at right angles to both of the arms and connecting the centers thereof, comprising:

providing a mold having first, second, third and fourth portions and a base for concreting said concrete block with the arms located horizontally one above the other and the web vertically;

filling said mold with concrete;

pivoting and first and second mold portions away from each other about a horizontal axis at the top thereof to expose lateral and upper surfaces of said block after said concrete has set whereby said first and second mold portions thereby may be reused;

supporting the upper arm by said third and fourth portions while said block rests on said base as the concrete cures; and pivoting said third and fourth portions away from each other about spaced axes at the bottom thereof to release the block after said concrete is cured;

said axis of said first and second portions being orthogonal with respect to the axes of said third and fourth portions.

2. A method as claimed in claim 1 in which all the concrete is charged through an upper, central charging opening.

3. A method as claimed in claim 2 in which the charged concrete is shaped by hand in the region of the filling opening.

4. A method as claimed in claim 2, in which the filling opening is closed with a cover after the greater proportion of concrete has been charged and then further concrete is charged below the cover for forming the shaped concrete block and the concrete is vibrated at the same time.

5. A method as claimed in claim 1 in which the concrete is vibrated in the lower part of the mold by means of vibrators mounted on the mold and in the upper part of the mold by means of vibrator rods inserted from above.

6. A method as claimed in claim 1 in which, after the concrete has cured, the shaped concrete block is lifted out of the mold by means of belts or cables passed below the upper arm.

* * * * *

UNITED STATES PATENT OFFICE
CERTIFICATE OF CORRECTION

PATENT NO. : 4,022,859

DATED : May 10, 1977

INVENTOR(S) : MAURO FIORETTO

It is certified that error appears in the above-identified patent and that said Letters Patent are hereby corrected as shown below:

Claim 1, line 10 (Col.6, line 24), change "and" (first) to -- said --

Signed and Sealed this

*Twenty-fifth* Day of *April 1978*

[SEAL]

*Attest:*

RUTH C. MASON
*Attesting Officer*

LUTRELLE F. PARKER
*Acting Commissioner of Patents and Trademarks*